US010014638B1

(12) United States Patent
McCracken

(10) Patent No.: US 10,014,638 B1
(45) Date of Patent: Jul. 3, 2018

(54) ULTRA-THIN USB-C CONNECTOR

(71) Applicant: Microsoft Technology Licensing, LLC, Redmond, WA (US)

(72) Inventor: Ivan A. McCracken, Bellevue, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 15/601,471

(22) Filed: May 22, 2017

Related U.S. Application Data

(60) Provisional application No. 62/437,430, filed on Dec. 21, 2016.

(51) Int. Cl.
*H01R 24/60* (2011.01)
*H01R 13/50* (2006.01)
*H01R 107/00* (2006.01)

(52) U.S. Cl.
CPC ..... *H01R 24/60* (2013.01); *H01R 13/50* (2013.01); *H01R 2107/00* (2013.01); *H01R 2201/06* (2013.01)

(58) Field of Classification Search
CPC ..... H01R 24/60; H01R 13/50; H01R 2107/00
USPC ..... 439/676
See application file for complete search history.

(56) References Cited

U.S. PATENT DOCUMENTS 7,182,646 B1 2/2007 Chou et al.
7,717,717 B1 * 5/2010 Lai ..... H01R 13/64 439/66
8,366,318 B2 * 2/2013 Zeller ..... A61B 6/145 378/168
9,318,856 B2 * 4/2016 MacDougall ..... H01R 13/6581
9,350,125 B2 * 5/2016 Jones ..... H01R 24/60
9,356,400 B2 * 5/2016 Little ..... H01R 4/023
9,450,337 B2 * 9/2016 Kao ..... H01R 13/6461
9,450,341 B2 * 9/2016 Kao ..... H01R 13/6585
9,590,363 B2 * 3/2017 Wu ..... H01R 13/6585
9,660,369 B2 * 5/2017 Lee ..... H01R 12/778
9,755,368 B2 * 9/2017 Cheng ..... H01R 13/6471
9,780,500 B2 * 10/2017 Kao ..... H01R 13/6658
9,787,008 B2 * 10/2017 Gou ..... H01R 12/53
9,787,009 B2 * 10/2017 Tsai ..... H01R 12/57
9,799,999 B1 * 10/2017 Tsai ..... H01R 24/60
9,806,464 B1 * 10/2017 Wang ..... H01R 13/6471
(Continued)

FOREIGN PATENT DOCUMENTS

CN 204391461 U 6/2015

OTHER PUBLICATIONS

Purcher, Jack, "Griffin's Break Safe Magnetic USB-C Power Cable for new MacBooks", Published on: Apr. 21, 2016 Available at: http://www.patentlyapple.com/patently-apple/2016/04/griffins-breaksafe-magnetic-usb-c-power-cable-for-new-macbooks-available-april-25.html.

*Primary Examiner* — Alexander Gilman
(74) *Attorney, Agent, or Firm* — Ray Quinney & Nebeker, P.C.; Paul Taylor; Qudus Olaniran

(57) ABSTRACT

A USB-C connector includes a plug tip and a cable. The USB-C connector includes a single, seamless, continuous, thin housing protecting a wire termination and contacts within the housing. The housing has a uniform thickness along the entire length of the housing. The housing may provide strain relief to the cable and an aesthetically pleasing USB-C connector. The connector may include an overmold residing inside the housing and over the wire termination and contacts.

21 Claims, 8 Drawing Sheets

(56) References Cited

U.S. PATENT DOCUMENTS

2008/0179075 A1* 7/2008 Tsao ..... H01B 7/0861 174/115
2008/0246576 A1* 10/2008 Terlizzi ..... H01F 17/06 336/175
2008/0274633 A1 11/2008 Teicher
2009/0215290 A1* 8/2009 Zhu ..... H01R 13/621 439/76.1
2009/0264011 A1* 10/2009 Wang ..... H01R 12/62 439/507
2010/0052620 A1* 3/2010 Wong ..... H02J 7/0055 320/137
2011/0022859 A1* 1/2011 More ..... G06F 1/3203 713/300
2012/0071021 A1 3/2012 Wu
2013/0115821 A1 5/2013 Golko et al.
2013/0217253 A1 8/2013 Golko et al.
2014/0206209 A1 7/2014 Kamei et al.
2014/0216781 A1* 8/2014 Shen ..... H01B 11/00 174/102 R
2015/0171561 A1* 6/2015 Little ..... H01R 24/60 439/607.34
2015/0173210 A1 6/2015 Ni et al.
2015/0194772 A1* 7/2015 Little ..... H01R 13/6597 439/357
2015/0270646 A1* 9/2015 Kao ..... H01R 13/6581 439/76.1
2015/0270659 A1* 9/2015 Kao ..... H01R 13/2442 439/607.01
2016/0006190 A1* 1/2016 Katsuura ..... H02H 5/04 439/502
2016/0013566 A1* 1/2016 Wu ..... H01R 4/023 439/676
2016/0093992 A1* 3/2016 Zhou ..... H01R 24/60 439/676
2016/0149348 A1* 5/2016 Kao ..... H01R 13/6585 439/607.05
2017/0005424 A1* 1/2017 Lee ..... H01R 12/778
2017/0025204 A1* 1/2017 Chapman ..... H01B 3/445
2017/0033518 A1* 2/2017 Cornelius ..... H01R 13/6471

* cited by examiner

ULTRA-THIN USB-C CONNECTOR

CROSS-REFERENCE TO RELATED APPLICATIONS

This application claims the benefit of U.S. Provisional Patent Application No. 62/437,430, filed on Dec. 21, 2016, which is hereby incorporated by reference in its entirety.

BACKGROUND

Background and Relevant Art

Use of computing devices is becoming more ubiquitous by the day. Computing devices range from standard desktop computers to wearable computing technology and beyond. Computing devices include various types of communication devices that can be used to connect a computing device with other computing devices and/or accessories.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages will be set forth in the description which follows, and in part will be obvious from the description, or may be learned by the practice of the teachings herein. Features and advantages of the disclosure may be realized and obtained by means of the instruments and combinations particularly pointed out in the appended claims. Features of the present disclosure will become more fully apparent from the following description and appended claims, or may be learned by the practice of the disclosure as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 2-1 is a perspective view of an embodiment of a USB-C connector;

FIG. 2-2 is a perspective view of the embodiment of the USB-C connector illustrated in FIG. 2-1;

FIG. 3-1 is an exploded view of an embodiment of a USB-C connector;

FIG. 3-2 is a perspective view of an embodiment of a wire termination of a USB-C connector;

DETAILED DESCRIPTION

This disclosure generally relates to locking apparatuses, systems, and methods. More particularly, this disclosure generally relates to locking apparatuses, systems, and methods for securing computing devices and/or related chords and plugs, such as for example a USB-C connector.

Figure 1:
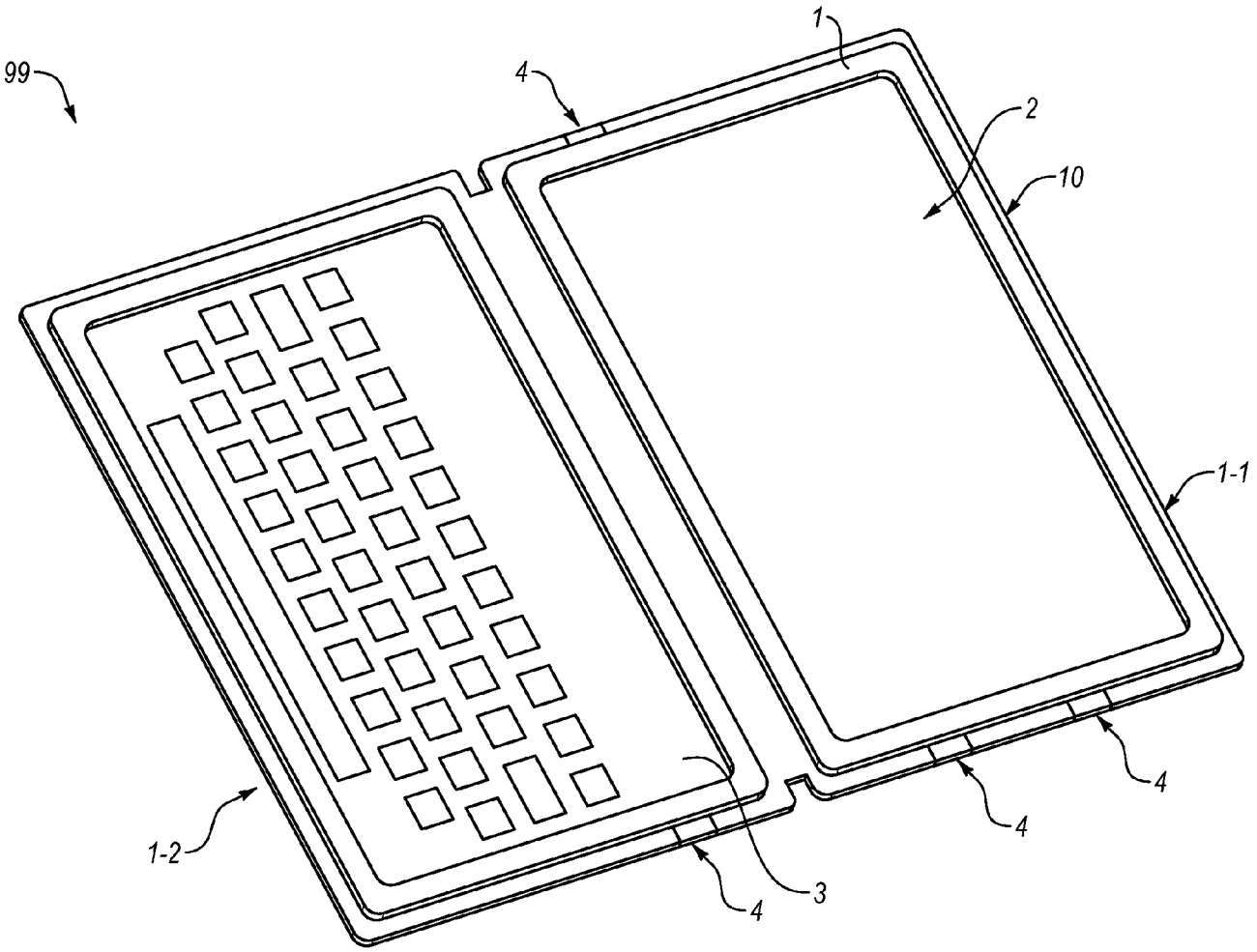
FIG. 1 is a perspective view of an embodiment of a computing device.

FIG. 1 is a perspective view of an embodiment of a computing device 99 that includes a structure with two portions 1-1, 1-2 for housing electronic components. The first portion 1-1 may include a display 2. The display 2 may display information (e.g., in a standard monitor) and/or act as an input (e.g., a touch screen monitor). The second portion 1-2 may include an input 3. The input 3 may be a keyboard. In other embodiments, the input 3 may also display information. For example, the input 3 may include a touch screen monitor. In some embodiments, the first portion 1-1 may include a display 2 and an input as a touch screen monitor and the second portion 1-2 may include an input 3 and a display as a touch screen monitor.

Although the computing device 99 is illustrated in a flat configuration, the computing device 99 may be moved from a flat configuration to a working configuration (e.g., where the user can see the display 2 and use the input 3) and/or to a closed configuration where the display 2 and the input 3 may be directly adjacent. For example, the computing device 99 may include a connector (not labeled), such as a hinge that may keep the display 2 in the working configuration. In another example, a kickstand (not shown) may be connected to the structure to keep the display 2 in the working configuration.

The computing device 99 may also include one or more processors (not shown), memory (not shown) in electronic communication with the one or more processors, and one or more USB-C receptacles 4 in electronic communication with the one or more processors and/or memory.

The computing device 99 may include one or more plug receptacles 4 that may receive one or more connectors described herein. For example, the receptacle 4 may be a USB-C receptacle configured to receive a USB-C connector 100. The one or more receptacles 4 may be located on either of the two portions 1-1, 1-2 of the computing device 99. The one or more receptacles 4 may be located at, or configured to receive a plug (e.g., USB-C connector 100 shown in FIG. 2-1) on an edge of the first and/or second portions 1-1, 1-2 of the computing device 99.

Figures 1, 2:
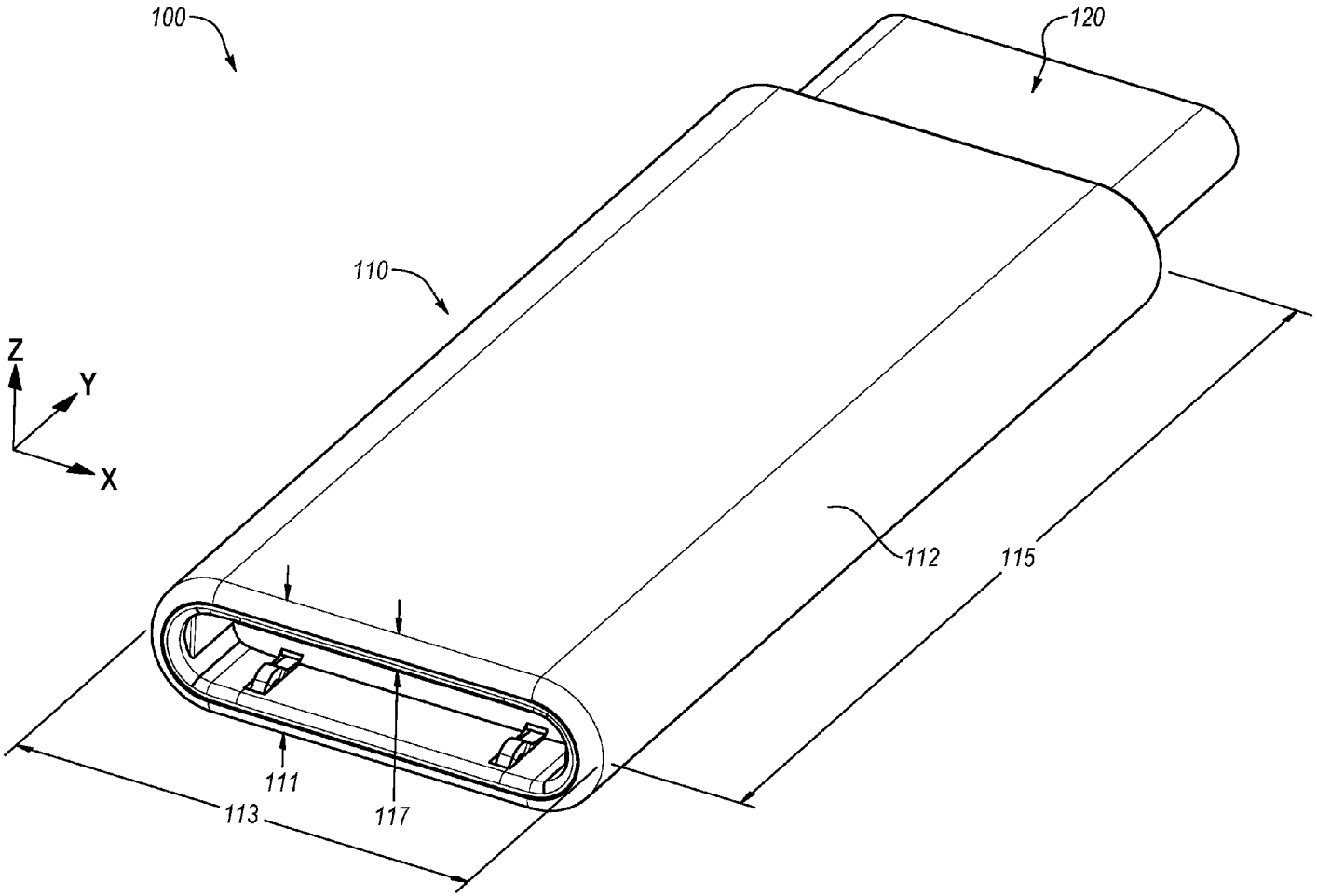
Figure 2:
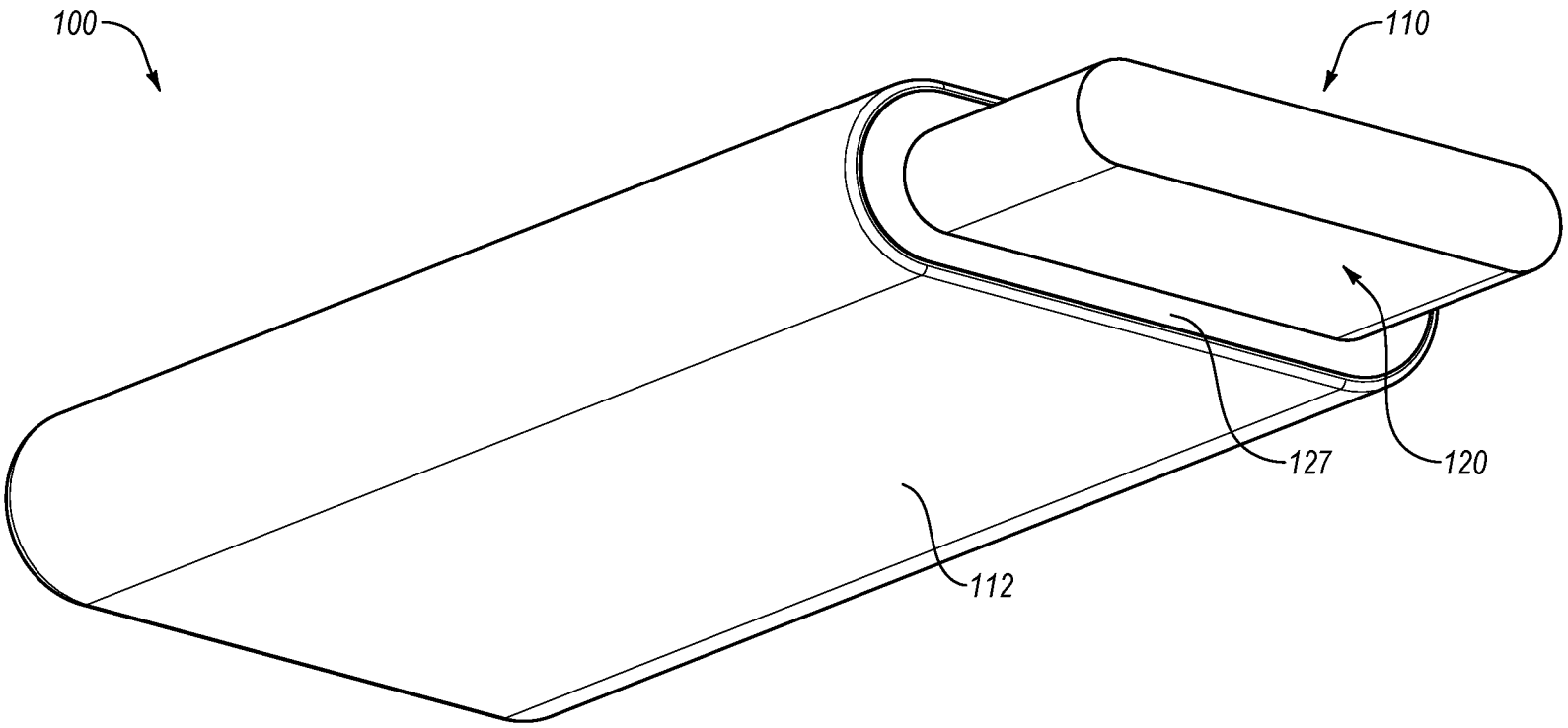

FIG. 2-1 illustrates a USB-C connector 100 including a plug tip 110 and cable 120. The plug tip 110 may include a housing 112. The housing 112 may have a uniform thickness 111 in the z-direction along the length of the housing 112 in the x direction. The housing 112 may have a maximum thickness 111 in the z-direction of less than about 2.43 mm. Other embodiments may include a housing 112 that may have a maximum thickness 111 in the z-direction of less than about 2.4 mm. In some embodiments, the maximum thickness 111 may be measured along the entire length of the housing 112. In other embodiments, the maximum thickness 111 may be measured within a distance of the end of the plug tip 110. For example, the maximum thickness 111 may be measured within a distance of 10% of the length of the housing 112. In another example, the maximum thickness 111 may be measured within a distance of between 5% and 15% and any values therebetween.

In the illustrated embodiment of FIGS. 2-1 and 2-2, the width 113 in the y-direction of the housing 112 remains constant along an entire length 115 in the x-direction of the housing 112. The housing 112 may have a maximum width 113 in the y-direction of 8.25 mm. Other embodiments of a USB-C connector may include a housing 112 that varies in width 113 in the y-direction along the length 115 of the housing 112 in the x-direction. In some embodiments, the maximum width 113 may be measured along the entire length 115 of the housing 112. In other embodiments, the maximum width 113 may be measured within a distance of the end of the plug tip 110. For example, the maximum width 113 may be measured within a distance of 10% of the length 115 of the housing 112. In another example, the maximum width 113 may be measured within a distance of between 5% and 15% and any values therebetween.

In the illustrated embodiment, the housing 112 may have a length 115 in the x-direction between about 10 mm and 25 mm. Other embodiments may include a housing 112 that may have a length 115 in the x-direction of greater than about 25 mm. Other embodiments of the USB-C connector 100 may include a housing 112 that may have a length 115 in the x-direction between about 12 mm and 20 mm. Still other embodiments may include a housing 112 that may have a length 115 in the x-direction between about 15 mm and 18 mm.

The housing 112 may be formed of a continuous, seamless tube. Other embodiments may include a housing 112 that is made of a tube with a seam. The housing 112 may be made of materials such as stainless steel, plated steel, plated bronze, or other metallic materials. In other embodiments, other non-metallic materials may be used. The housing wall thickness 117 may be between 5 and 35 mm.

The uniform, constant cross-section of the housing 112 may provide an aesthetically pleasing USB-C connector 100 that looks particularly clean and simple. Typical USB-C connectors may be bulky and non-uniform due to a plug external overmold located adjacent to the plug tip that is inserted into a plug receptacle. The typical USB-C connector has a non-uniform thickness due to the increased thickness of the external overmold. The external overmold may be less aesthetically appealing and/or may cause issues when plugged in to a computing device 99 that is thinner than the external overmold. For example, an external overmold that is thicker than the device would cause the device to rest on the external overmold when placed on a rigid surface, such as a wooden table. This may cause the device to sit awkwardly and exert unwanted forces on the USB-C connector. These forces may damage the USB-C connector and/or the USB-C receptacle located in the computing device.

The housing 112 of the USB-C connector 100 illustrated in FIGS. 2-1 and 2-2 may not include an external overmold that is thicker than the plug tip 110. Instead, the external overmold may be eliminated such that the housing 112 of the plug tip 110 remains as thin as required by a standard USB-C receptacle 4 along, for example, the entire length of the housing 112. Therefore, one or more embodiments of USB-C connectors 100 described herein may not be thicker than the computing device 99 in which it is inserted because, for example, the computing device may not be thinner than its USB-C receptacle 4.

The cross-sectional geometry of the housing 112 in the Z-Y plane may be configured such that it may be plugged into and retained in a standard USB-C receptacle 4. The housing 112 may also be configured to protect internal wire terminations of the cable (described in further detail below) as well as connections between various wires inside the cable 120 and one or more USB-C contact jumpers 130 and/or one or more printed circuit boards disposed within the housing 112 of the plug tip 110. The housing 112 may also be configured to provide strain relief to the cable 120.

FIG. 2-2 illustrates the embodiment of the USB-C connector 100 illustrated in FIG. 2-1, but from a perspective view showing how the cable 120 may interface with the plug tip 110 and/or housing 112. An external overmold 127 may be provided inside the housing 112 that encapsulates wire terminations of the cable 120 and/or a plurality of power wires and/or ground wires and/or data wires within the housing 112. The external overmold 127 may be configured to provide strain relief and/or insulation to the wire terminations of the cable 120 within the housing 112.

As illustrated in FIG. 2-2, the cable 120 thickness and width may be less than the thickness 111 in the z-direction and width 113 in the y-direction of the housing 112, respectively. In other embodiments, the thickness in the z-direction and width in the y-direction of the cable may be equal to the thickness 111 and width 113 of the housing 112. The cable 120 may have a similar cross-sectional geometry as the housing 112. For example, the cable 120 may have a width 113 in the y-direction that is greater than the thickness 111 in the z-direction. This oblong and/or flat cross-sectional configuration may differ from a typical cable, which may have a circular cross-section. In order for the cable to provide a sufficient amount of power and/or data, with less than a 500 mV drop across the length of the cable, while maintaining its thin profile and flexibility, a plurality of wires may be configured side-by-side within the cable 120.

Figures 1, 3:
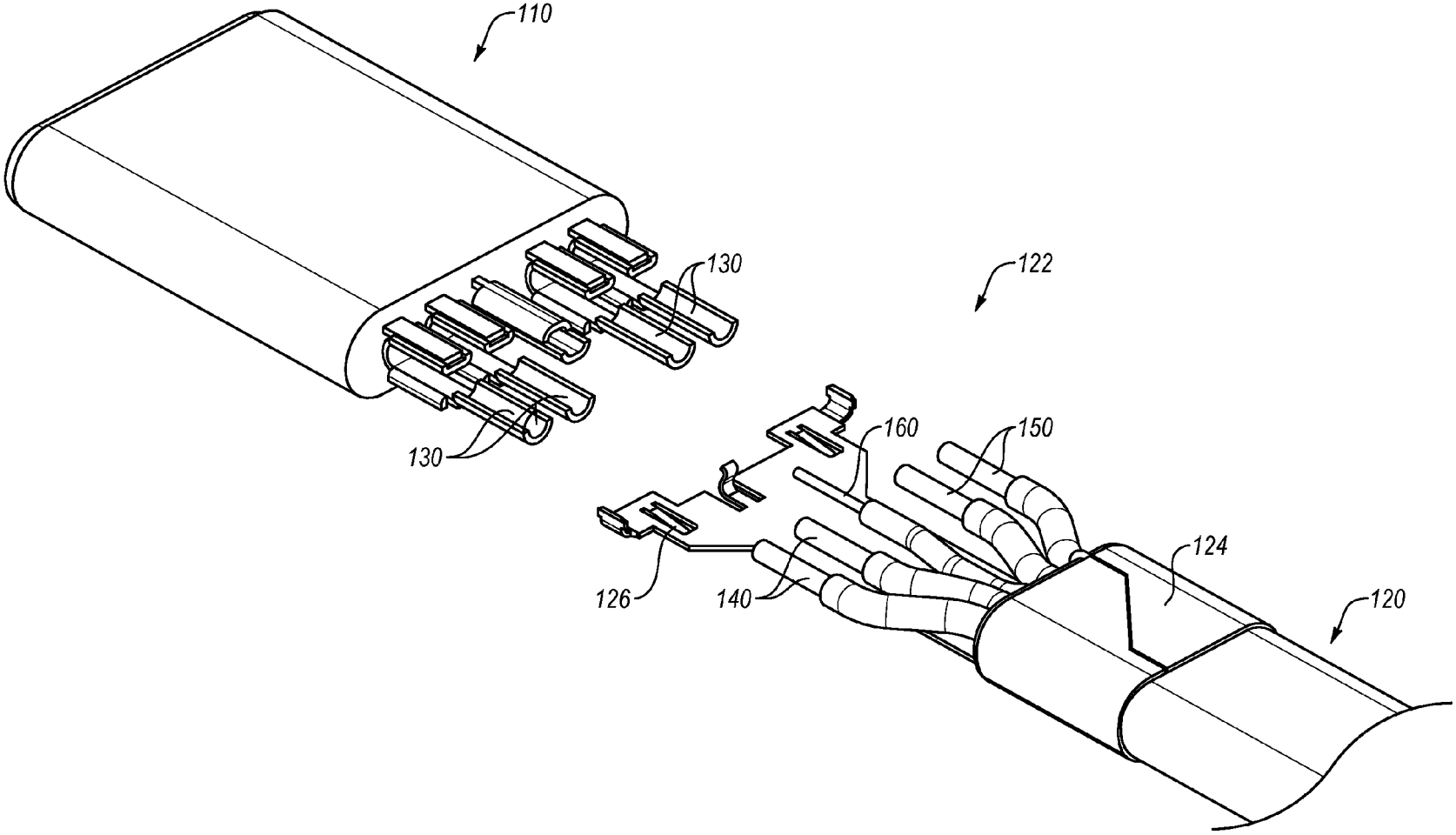
Figures 2, 3:
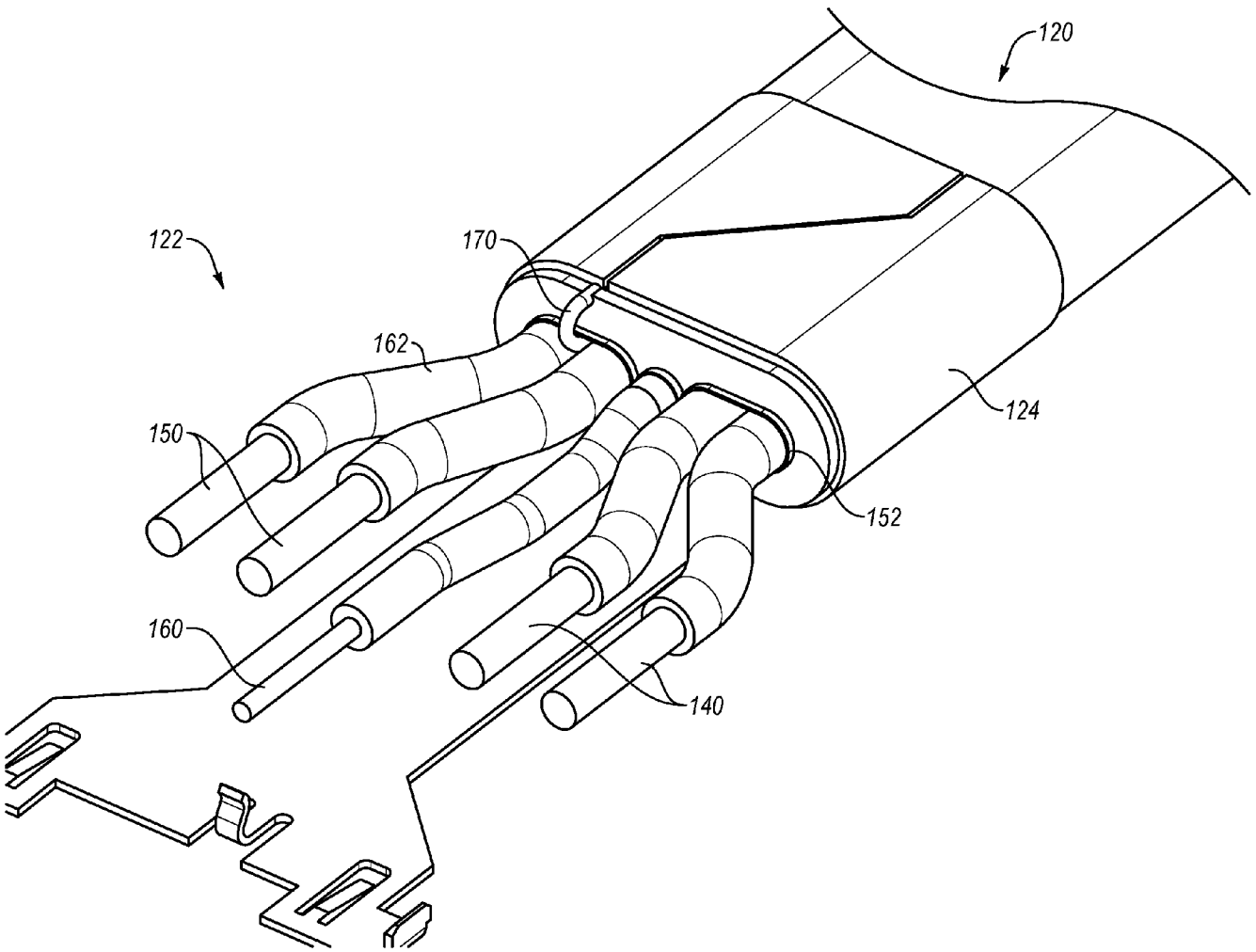

FIG. 3-1 illustrates an exploded view of the embodiment of the USB-C connector 100 illustrated in FIGS. 2-1 and 2-2. The housing 112 is not shown. The cable 120 may include a collar 124 at a distal end near the wire termination 122.

The collar may reside inside the housing 112 and be rigid to provide structural strength and/or a ground contact to the end of the cable. A plurality of wires 140, 150, 160 may extend out from the cable 120 into the wire termination 122. An external overmold (not shown) may be included at the wire termination 122 to protect the various wires and/or structures therein. One or more ground springs 126 may also be provided configured to make contact with the housing 112 (not shown).

The plug tip 110 may include one or more contact jumpers 130. The contact jumpers 130 may be configured to make contact with the plurality of power wires 140 and ground wires 150 extending from the cable 120 at the wire termination 122. The one or more contact jumpers 130 may be configured to contact and/or receive the plurality of power wires 140, ground wires 150, data wires 160, or combinations thereof and transfer the power signals and/or data signals through the plug tip 110 to a computing device 99 via a USB-C receptacle 4.

In order for the cable to provide a sufficient amount of power and/or data, with less than a 500 mV drop across the length of the cable, while maintaining its thin profile and flexibility, a plurality of wires may be configured side-by-side within the cable 120. FIG. 3-2 illustrates an embodiment where a plurality of wires 140, 150, 160 are configured side by side and extend out from the cable 120 into the wire termination 122. The plurality of wires may include one or more power wires 140, one or more ground wires 150, and one or more data wires 160. Each wire 140, 150, 160 may reside within a wire sheath 162. The wire sheaths 162 may configured to protect and/or insulate each wire 140, 150, 160. The one or more power and/or ground wires 140, 150 may be made of gold, silver plated copper, or other conductive materials.

In the illustrated embodiment, two ground wires 150 are paired together on the left side of the cable 120 and two power wires 140 are paired together on the other side of the cable 120. A shielding wrap 152 may surround each pair of wires 140, 150. The shielding wraps 152 may provide insulation and may isolate the power wires 140 from the ground wires 150 and/or one or more data wires 160 to decrease electrical interference between the different types of wires 140, 150, 160. A drain wire 170 may also extend from within the shielding wrap 152 of the ground wires 150 and make contact with the collar 124.

Figure 4:
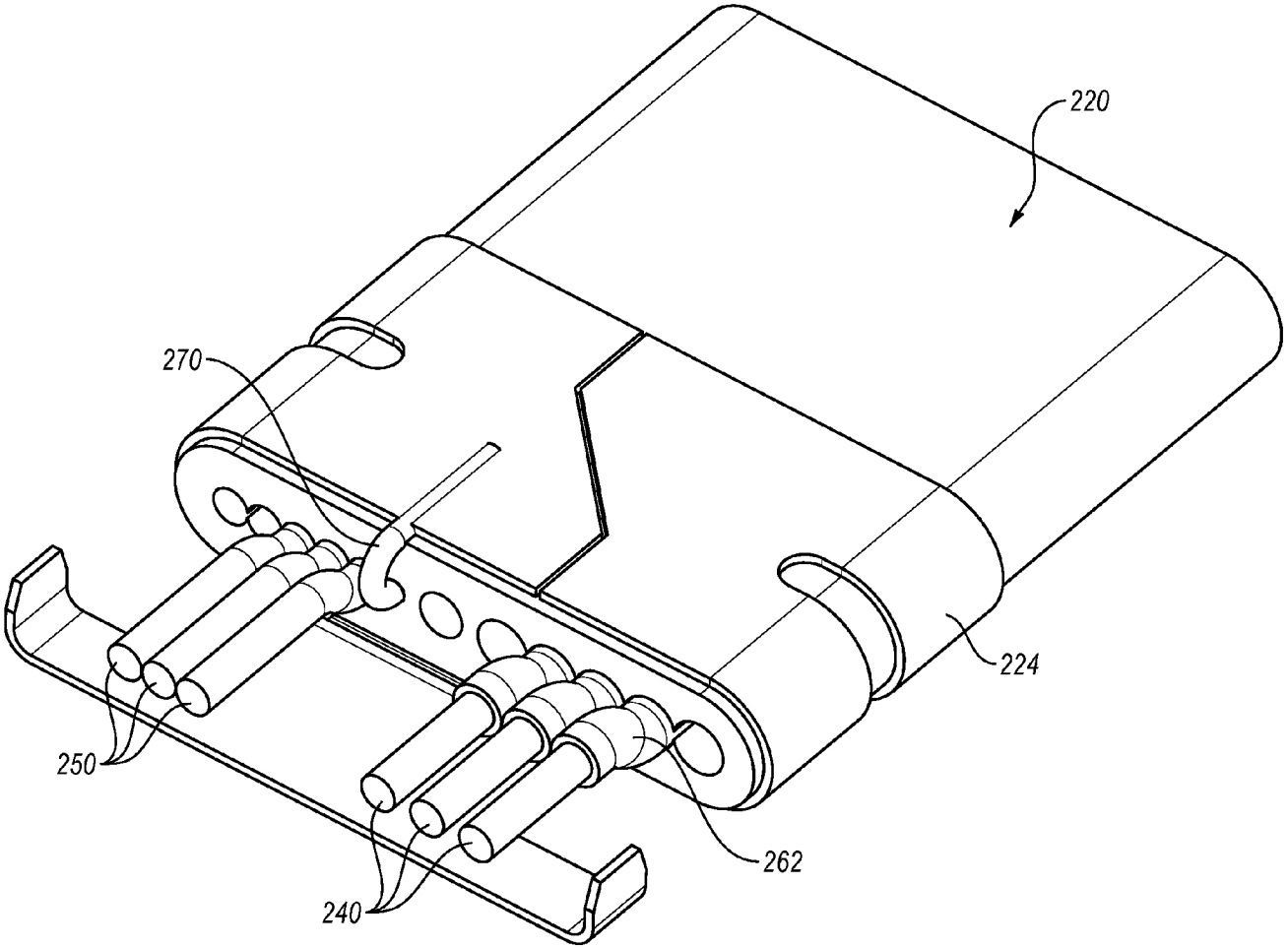
FIG. 4 is a perspective view of another embodiment of a wire termination of a USB-C connector.
Figure 5:
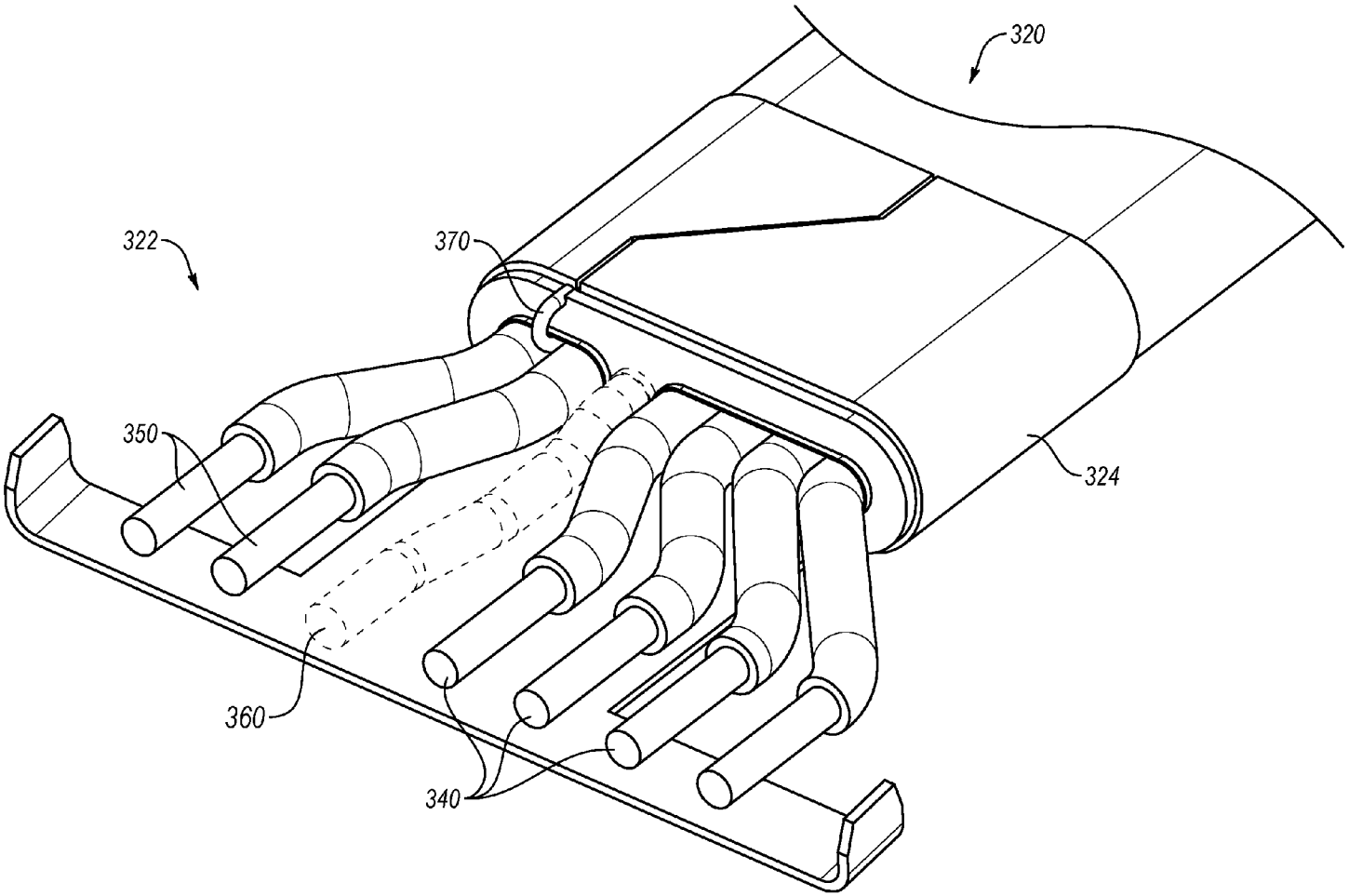
FIG. 5 is a perspective view of an embodiment of a wire termination of a USB-C connector.

The wires illustrated in FIG. 3-2 are an example of one embodiment of a plurality of wires 140, 150, 160 residing within the cable 120 and extending out from the cable 120 to the wire termination 122. Other embodiments may include more or less of each of the wires 140, 150, 160 illustrated in FIG. 3-2. FIG. 4 illustrates another embodiment of a cable 220 that includes three power wires 240, three ground wires 250, and no data wire. FIG. 5 illustrates another embodiment of a cable 320 that includes four power wires 340, two ground wires 350. A single data wire 360 may also be provided.

In each of the illustrated embodiments of FIGS. 3-1 through 5, the one or more power wires 140, 240, 340 may be bundled together within a shielding wrap 152. The one or more ground wires 150 may be bundled together within a separate shielding wrap 152. In yet other embodiments, any combination of power wires 140, 240, 340, ground wires 150, 250, 350, and data wires 260, 360 may be provided that may achieve less than a 500 mV drop along the length of the cable 120, 220, 320 while supplying 3 amperes of power at 20 Volts.

Also, some embodiments may include one or more data wires 260, 360 and some embodiments may include none. For example, some embodiments may include one CC communication wire and two to five power wires 140, 240, 340 and two to five ground wires 150, 250, 350 on either side. Also for example, an embodiment may include a CC communication wire, a D+ wire, and a D− wire. D+ and D− wires may be used to facilitate USB data or other data communication. An example embodiment of which may be found in FIG. 6. A plurality of ground wires 150, 250, 350 and power wires 140, 240, 340 may be disposed on either side. Each of the described embodiments may include two, three, four, five, six seven or eight power wires 140, 240, 340 and/or two, three, four, five, six seven or eight ground wires 150, 250, 350.

Some embodiments may include the same number of ground and power wires 150, 250, 350, 140, 240, 340. For example, an embodiment may include three power wires 140, 240, 340 and three ground wires 150, 250, 350, or five power wires 140, 240, 340 and five ground wires 150, 250, 350. Other embodiments may include a different number of ground and power wires 150, 250, 350, 140, 240, 340. For example, an embodiment may include three ground wires 150, 250, 350 and five power wires 140, 240, 340, or two power wires 140, 240, 340 and four ground wires 150, 250, 350. In each embodiment described herein, the plug tip 110, 210, 310 may include a corresponding number of contact jumpers (e.g., contact jumpers 130 shown in FIG. 3-1) for each of the power and ground wires 140, 240, 340, 150, 250, 350.

It may be appreciated from the foregoing description that any number of combinations of power wires, ground wires, and data wires may be provided within the cable so long as power and data signals can be maintained without excessive interference between wires and less than a 500 mV drop across the length of the cable is achieved.

Figure 6:
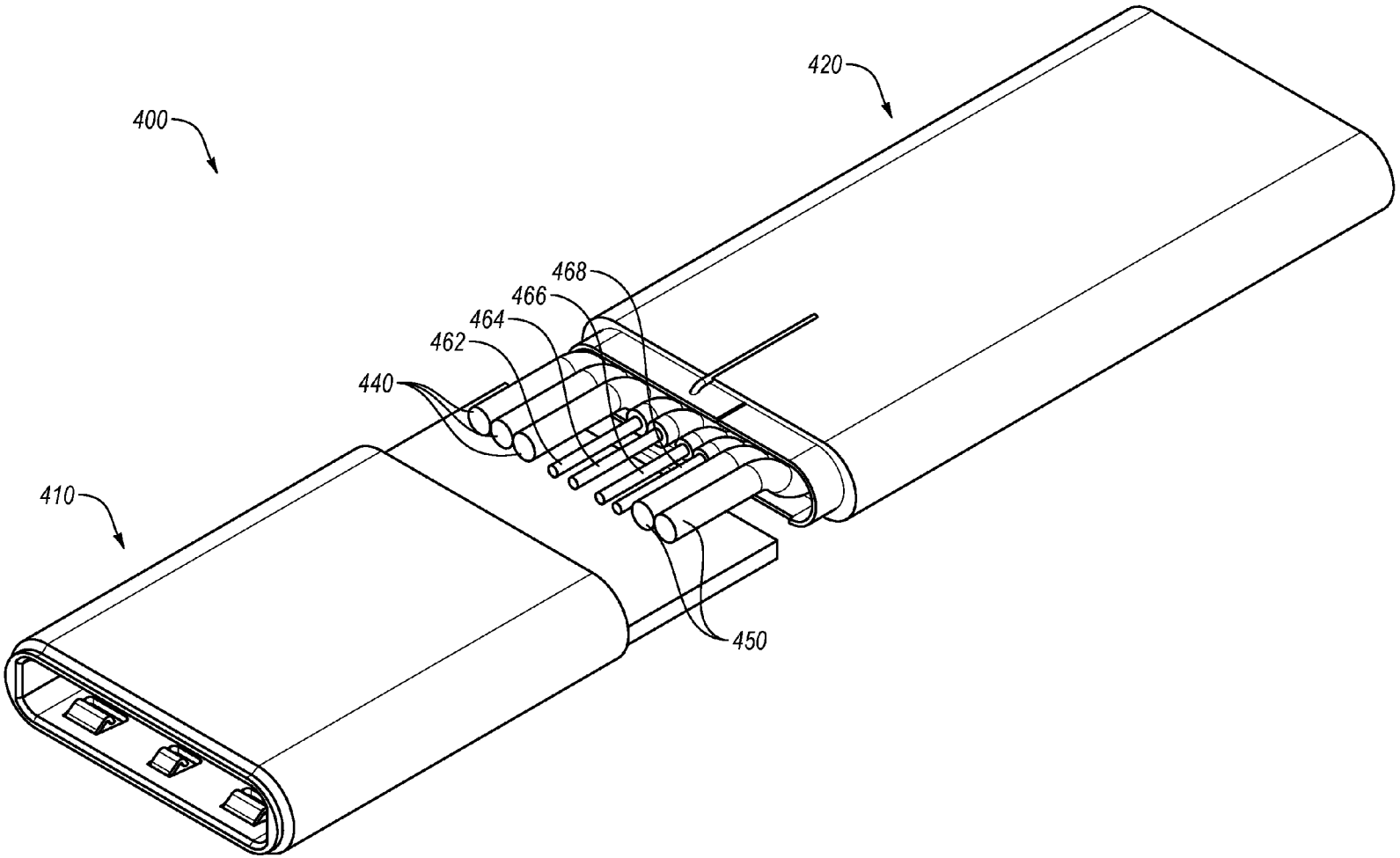
FIG. 6 is a partially exploded perspective view of another embodiment of a USB-C connector.

FIG. 6 illustrates a further embodiment of USB-C connector 400 including a plug tip 410 and cable 420. The USB-C connector 400 may be a type C USB 2.0 cable. Although shown with a single plug tip 410, a plug tip on another end on the cable 420 may be included. As shown, the USB-C connector 400 includes three power wires 440, a D+ wire 462, a D− wire 464, a CC wire 466, a Vbus wire 468, and two ground wires 450. In some embodiments, one or more of the wires may be optional. For example, the Vbus wire 468 may be optional.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

It should be understood that any directions or reference frames in the preceding description are merely relative directions or movements. For example, any references to "front" and "back" or "top" and "bottom" or "left" and "right" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A USB-C connector, comprising:

a USB-C plug tip;

a plurality of contacts connected to the USB-C plug tip;

a USB-C cable having a plurality of ground wires and a plurality of power wires, the plurality of power wires and the plurality of ground wires connected to one or more of the plurality of contacts, the USB-C cable having a wire termination; and a housing encapsulating the plurality of contacts, the plurality of ground wires, and the plurality of power wires at the wire termination, the housing being non-conductive, the housing having a maximum cross-sectional width and a maximum cross-sectional thickness, the maximum cross-sectional thickness being less than 2.43 mm along its length.

2. The connector of claim 1, wherein the connector does not have a power communication wire.

3. The connector of claim 1, the USB-C cable having at least one power communication wire.

4. The connector of claim 2, wherein the at least one power communication wire is a data wire.

5. The connector of claim 4, wherein the at least one data wire is a single CC wire.

6. The connector of claim 4, wherein the at least one data wire includes two or more of a CC wire, a D+ wire, and a D− wire.

7. The connector of claim 1, the housing having a continuous, seamless outer surface about a circumference of the USB-C plug tip.

8. The connector of claim 7, the housing having a continuous, seamless outer surface about a circumference from cable tip to cable termination.

9. The connector of claim 7, wherein the housing has a uniform, constant thickness.

10. The connector of claim 1, the housing being formed of stainless steel, plated steel, or plated bronze.

11. The connector of claim 1, the housing including a cable overmold encapsulating the plurality of ground wires and the plurality of power wires.

12. The connector of claim 11, the cable overmold within the housing.

13. The connector of claim 1, wherein the plurality of power wires includes at least two power wires.

14. The connector of claim 13, wherein the plurality of power wires includes at least three power wires.

15. The connector of claim 1, wherein the plurality of power wires or the at least one ground wire is gold, or silver plated copper.

16. The connector of claim 1, the plurality of power wires having a voltage drop of less than 500 mV.

17. The connector of claim 1, wherein the housing has an overall length of between 10 and 25 mm.

18. The connector of claim 17, wherein the housing has a maximum cross-sectional width is 8.25 mm.

19. The connector of claim 18, wherein the housing having a maximum cross-sectional thickness is less than 2.40 mm.

20. A USB-C connector, comprising:

a USB-C plug tip;

a plurality of contacts connected to the USB-C plug tip;

a USB-C cable having two ground wires and two power wires, the power wires connected to two power contacts, the ground wires connected to two ground contacts, the USB-C cable having a wire termination;

a housing including an external overmold, the housing having a continuous, seamless outer surface about a circumference of the USB-C plug tip, the housing encapsulating the power contacts, the ground contacts, the plurality of ground wires, and the plurality of power wires at the wire termination, the housing having a maximum cross-sectional width and a maximum cross-sectional thickness, the maximum cross-sectional thickness being less than 2.40 mm along its length.

21. A computing device comprising:

a processor;

memory in electronic communication with the processor;

a USB-C receptacle in electronic communication with the processor and the memory; and a USB-C connector, comprising:

a USB-C plug tip;

a plurality of contacts connected to the USB-C plug tip;

a USB-C cable having a plurality of ground wires and a plurality of power wires, the plurality of power wires and the plurality of ground wires connected to one or more of the plurality of contacts, the USB-C cable having a wire termination; and a housing encapsulating the plurality of contacts, the plurality of ground wires, and the plurality of power wires at the wire termination, the housing being non-conductive and having a maximum cross-sectional width and a maximum cross-sectional thickness, the maximum cross-sectional thickness is less than 2.43 mm.

* * * * *